US010004972B2

(12) United States Patent
Young

(10) Patent No.: US 10,004,972 B2
(45) Date of Patent: Jun. 26, 2018

(54) STATIONARY STRENGTH TRAINING EQUIPMMENT WITH LOCKABLE BILATERAL USER INTERFACE

(71) Applicant: Calgym Group Holdings Pty. Ltd., Queensland (AU)

(72) Inventor: Leo Young, Queensland (AU)

(73) Assignee: CALGYM GROUP HOLDINGS PTY. LTD., Queensland (AU)

( * ) Notice: Subject to any disclaimer, the term of this patent is extended or adjusted under 35 U.S.C. 154(b) by 116 days.

(21) Appl. No.: 15/358,404

(22) Filed: Nov. 22, 2016

(65) Prior Publication Data

US 2017/0157489 A1 Jun. 8, 2017

Related U.S. Application Data

(60) Provisional application No. 62/264,284, filed on Dec. 7, 2015.

(51) Int. Cl.

| | |
|---|---|
| ***A63B 21/00*** | (2006.01) |
| ***A63B 24/00*** | (2006.01) |
| ***A63B 71/06*** | (2006.01) |
| ***A63B 21/062*** | (2006.01) |
| ***A63B 23/035*** | (2006.01) |

(52) U.S. Cl.

CPC .... *A63B 71/0622* (2013.01); *A63B 21/00069* (2013.01); *A63B 21/063* (2015.10); *A63B 21/4035* (2015.10); *A63B 23/03516* (2013.01); *A63B 24/0062* (2013.01); *A63B 2220/833* (2013.01)

(58) Field of Classification Search

CPC ..... A63B 71/0622; A63B 21/063; A63B 21/4035; A63B 23/03516; A63B 21/00069; A63B 24/0062; A63B 2220/833

USPC ..... 482/8

See application file for complete search history.

(56) References Cited

U.S. PATENT DOCUMENTS

| | | | | |
|---|---|---|---|---|
| 8,636,631 | B2 * | 1/2014 | Carlson | A63B 21/4003 482/127 |
| 9,095,492 | B2 * | 8/2015 | Verkaaik | A61H 1/0274 |
| 2010/0279821 | A1 * | 11/2010 | Cole | A63B 24/00 482/4 |
| 2014/0256516 | A1 * | 9/2014 | Calderone | A61B 5/103 482/98 |

* cited by examiner

*Primary Examiner* — Andrew S Lo
(74) *Attorney, Agent, or Firm* — Chun-Ming Shih

(57) ABSTRACT

A stationary strength training equipment includes a frame assembly, a lockable bilateral user interface installed on the frame assembly, a balancing structure connected to the lockable bilateral user interface, a plurality of user selectable weights supported by the frame assembly and connected to the balancing structure, a load detecting strain gauge disposed on the user selectable weights to detect a weight of the user selectable weights being lifted, and an informing device connected to the lockable bilateral user interface to detect and show a warning signal to a user. The lockable bilateral user interface further includes a locking mechanism assembly and a central pivot assembly; the balancing structure is able to rotate along the central pivot assembly, and the locking mechanism assembly selectively restricts a rotation of the balancing structure.

5 Claims, 10 Drawing Sheets

STATIONARY STRENGTH TRAINING EQUIPMMENT WITH LOCKABLE BILATERAL USER INTERFACE

BACKGROUND

1. Technical Field

The technical field relates to a stationary strength training equipment which is able to notify the users of the imbalance of their muscles during the training exercise.

2. Background of the Invention

With traditional stationary strength training equipment, the right and left sides of the body or limbs jointly operate the mechanism of the plate loaded or selectorised (pin loaded) stationary strength training equipment. This "joint operation" however does not provide identical right/left muscle group training as the dominate side produces the greatest work effort. One is not aware of this difference during the course of a normal workout.

Coincidental with this is the fact that little mental or sensory exercise occurs whilst using Stationary Strength Training Equipment.

This is relevant to all users; however it is particularly noticeable with certain rehabilitation clients who may have one dominate side and one weaker side and need to focus greater training effort on the weaker side.

Users and rehabilitation clients who have to train one side of their body to a greater extent than the other may have to use a single handed approach to strength training. This may be effective, however it takes much more time and it remains difficult to then compare the strength of each side of the body. Mentally, the client may continue to believe that one side of the body or a particular limb, remains weaker than the other side of the body.

Therefore, a Stationary Strength Training Equipment addressing these issues by providing the choice of user interface independence or semi-independence to each of the right and left limbs to the user interfaces is needed.

BRIEF SUMMARY OF THE INVENTION

The purpose of a preferred embodiment of the present invention is to provide a stationary strength training equipment which includes a frame assembly, a lockable bilateral user interface installed on the frame assembly, a balancing structure connected to the lockable bilateral user interface, a plurality of user selectable weights supported by the frame assembly and connected to the balancing structure, a load detecting strain gauge disposed on the user selectable weights to detect a weight of the user selectable weights being lifted, and an informing device connected to the lockable bilateral user interface to detect and show a warning signal to a user. The lockable bilateral user interface further includes a locking mechanism assembly and a central pivot assembly; the balancing structure is able to rotate along the central pivot assembly, and the locking mechanism assembly selectively restricts a rotation of the balancing structure.

More specifically, when the locking mechanism assembly is unlocked, the balancing structure is able to rotate when uneven force is applied to both opposite sides of the balancing structure, and the informing device is able to show an imbalance warning signal to a user.

The stationary strength training equipment according to the present invention, wherein the balancing structure can be a rod, a press plate, or a handgrip, etc.

By using the stationary strength training equipment according to the present invention, the user can quickly determine if the strength and thus the training of the right and left muscle groups of the part of the body being exercised, is equal or balanced. In this instance, the user may modify their training program and modify the training regime accordingly.

BRIEF DESCRIPTION OF THE DRAWINGS

These and other features and advantages of the various embodiments disclosed herein will be better understood with respect to the following description and drawings, in which like numbers refer to like parts throughout, and in which.

DETAILED DESCRIPTION

Figure 1:
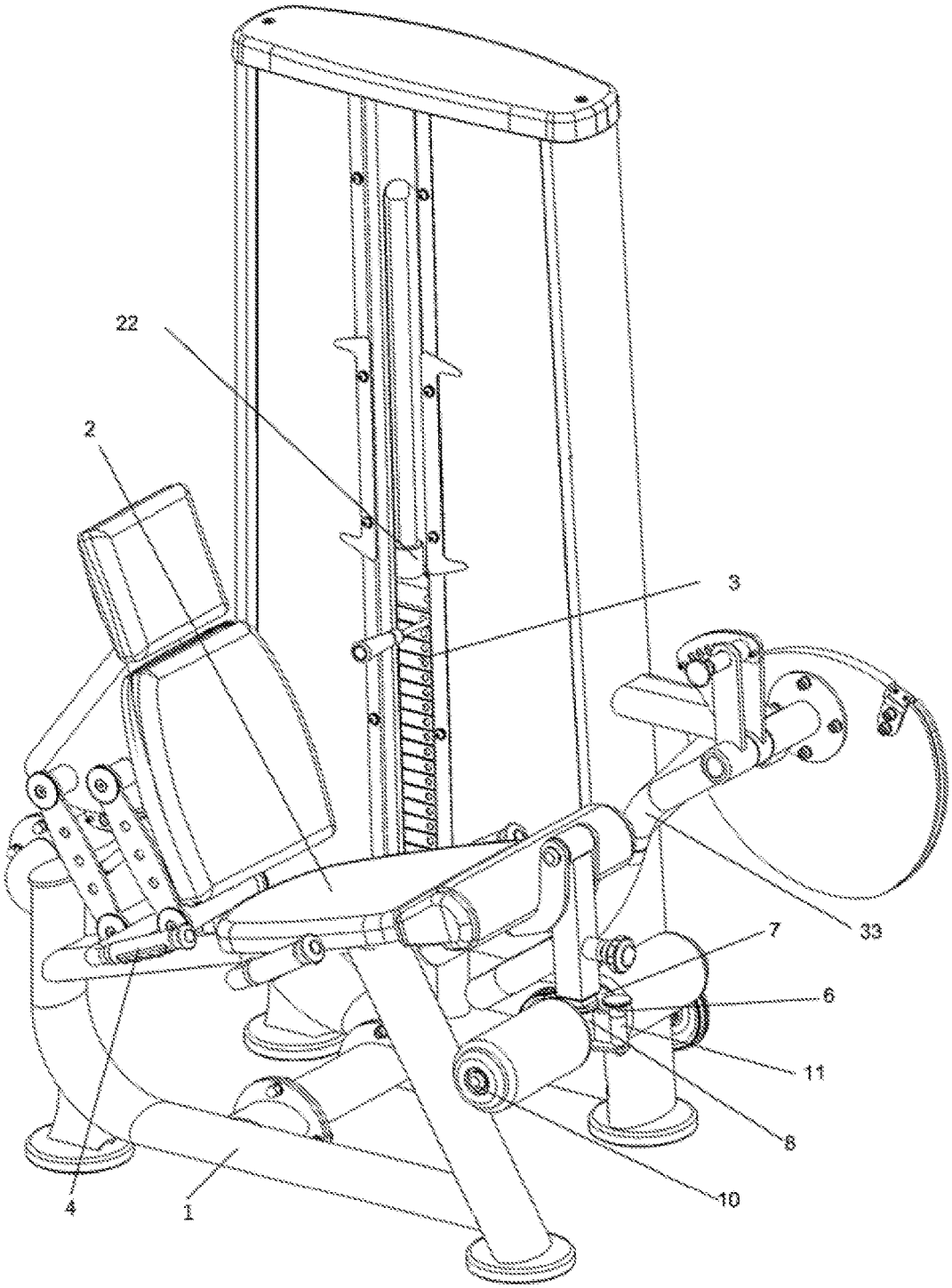
FIG. 1 shows one of the preferred embodiment and the main components of the stationary strength training equipment with a lockable bilateral user interface.
Figure 2:
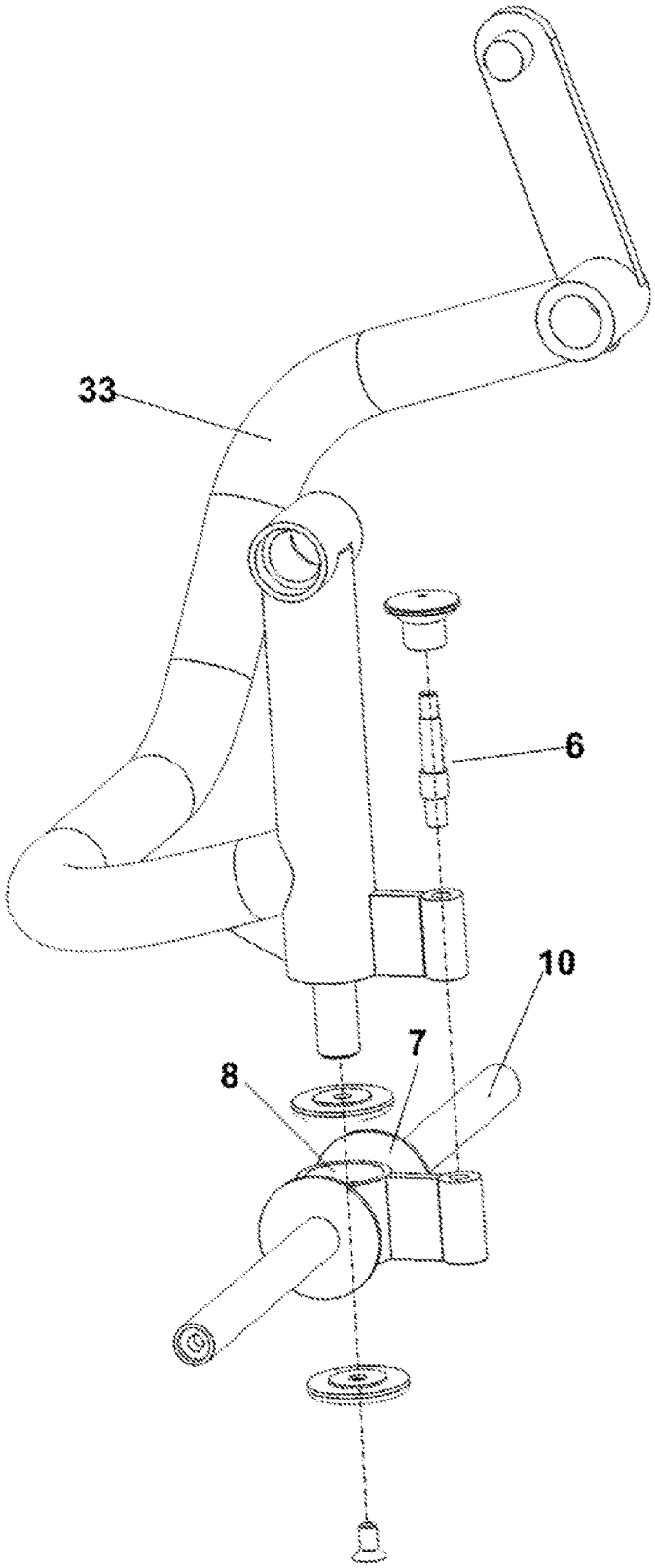
FIG. 2 shows the main components of the locking and pivoting mechanism of the stationary strength training equipment with a lockable bilateral user interface as shown in FIG. 1.
Figure 3:
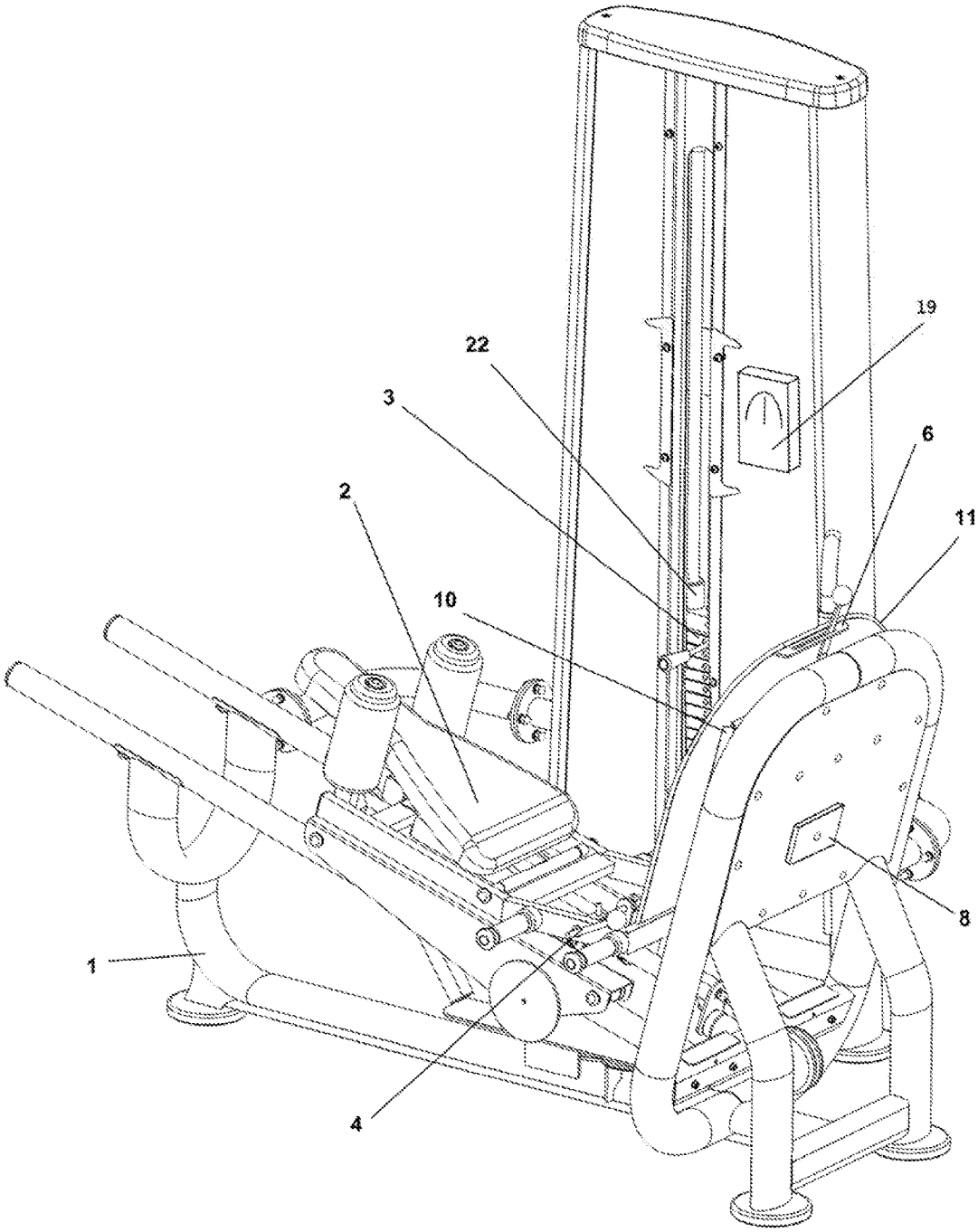
FIG. 3 shows one of the preferred embodiment and the main components of the stationary strength training equipment with a lockable bilateral user interface.

Referring to FIGS. 1 and 2, one of the preferred embodiments of the stationary strength training equipment according to the present invention is a leg extension machine, which mainly includes a frame assembly (1), a plurality of user selectable weights (3), a lockable bilateral user interface (11), a load detecting strain gauge (22), a position sensor module (8), and an informing device (19) (see FIG. 3). The frame assembly (1) is the structural frame of this leg extension machine. The user sits on a seat (2) which is adjustable in height and position for ability and comfort by a seat adjustment (4). The user selectable weight (3) is controlled by cables, via pulleys, connected via a lifting assembly (33) to the lockable bilateral user interface (11) consisting of a locking mechanism assembly (6) and a central pivot assembly (7).

The lockable bilateral user interface (11) further has a balancing structure (10), preferably a rod, extending from both sides of the central pivot assembly (7), and the locking mechanism assembly (6) disposes at the center of the balancing structure (10) for controlling the rotation thereof. Preferably, the balancing structure (10) is covered by an ankle cushion for the user's comfort. When the locking mechanism assembly (6) is locked, the balancing structure (10) cannot rotate even if different intensity of force is applied to the left side and right side thereof, so the stationary strength training equipment according to the present invention can only act like a traditional training machine. However, when the locking mechanism assembly (6) is unlocked and the user's body applies different force on left side and right side of the balancing structure (10), the balancing structure (10) can pivotally rotate along the central pivot assembly (7), and the position sensor module (8) can detect the rotation angle and send out a warning signal to the informing device (19) to notify the user that one side of the user's body has less strength when compared to the other side. Therefore, the user can quickly determine if the strength and thus the training of the right and left muscle groups of the part of the body being exercised, is equal or balanced. In this instance, the user may modify their training program and modify the training regime accordingly.

Figure 4:
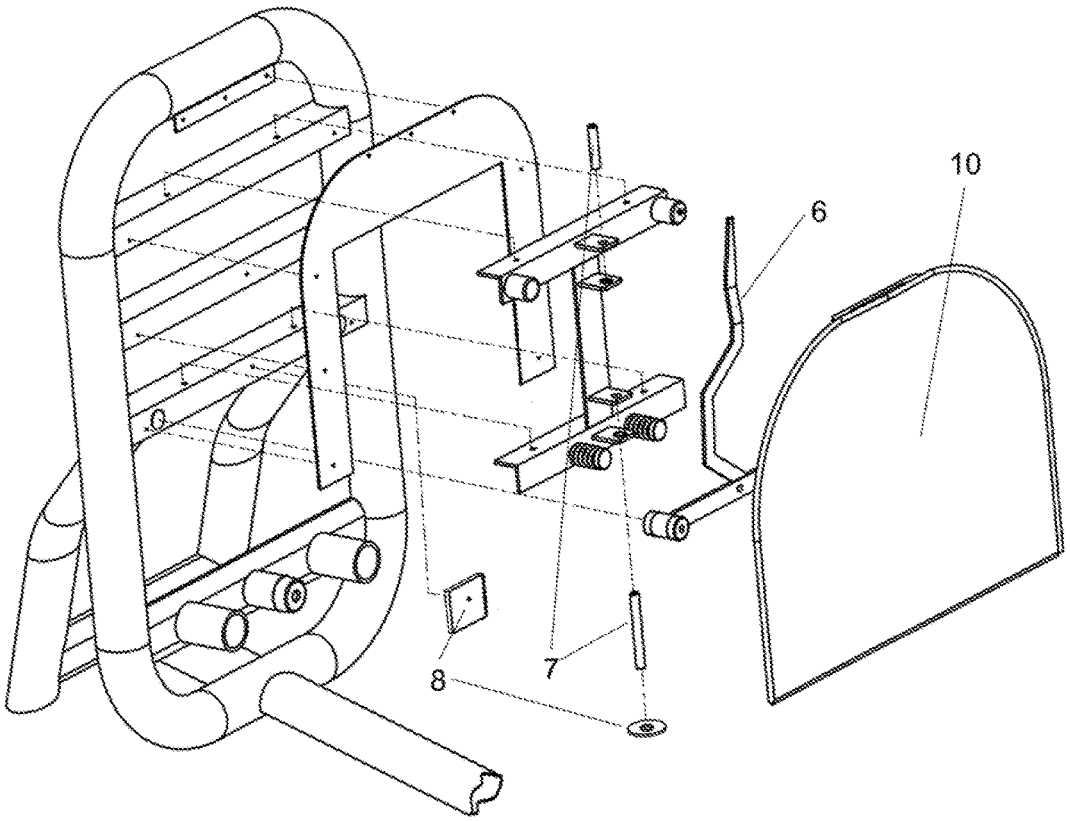
FIG. 4 shows the main components of the locking and pivoting mechanism of the stationary strength training equipment with a lockable bilateral user interface as shown in FIG. 3.

Referring to FIGS. 3-4, one of the preferred embodiments of the stationary strength training equipment according to the present invention is a leg press machine, which includes the lockable bilateral user interface (11) for enhanced bilateral strength training of the lower body. The leg press machine may be used in the seated or lying position.

As embodied in FIG. 3, the frame assembly (1) is the structural frame of the leg press machine. In this configuration, the user lies on the seat (2) which is adjustable in position for ability and comfort by the seat adjustment (4). The user selectable weight (3) with a load detecting strain gauge (22) is controlled by cables, via pulleys, connected to the lockable bilateral user interface (11) consisting of a balancing structure (10), a locking mechanism assembly (6), a central pivot assembly (7), a position sensor module (8) and the informing device (19).

Different from the previous embodiment, the balancing structure (10) is preferably a footplate. The operation mechanism of the leg press machine is similar to the previous embodiment and thus not repeated hereinafter.

Figure 5:
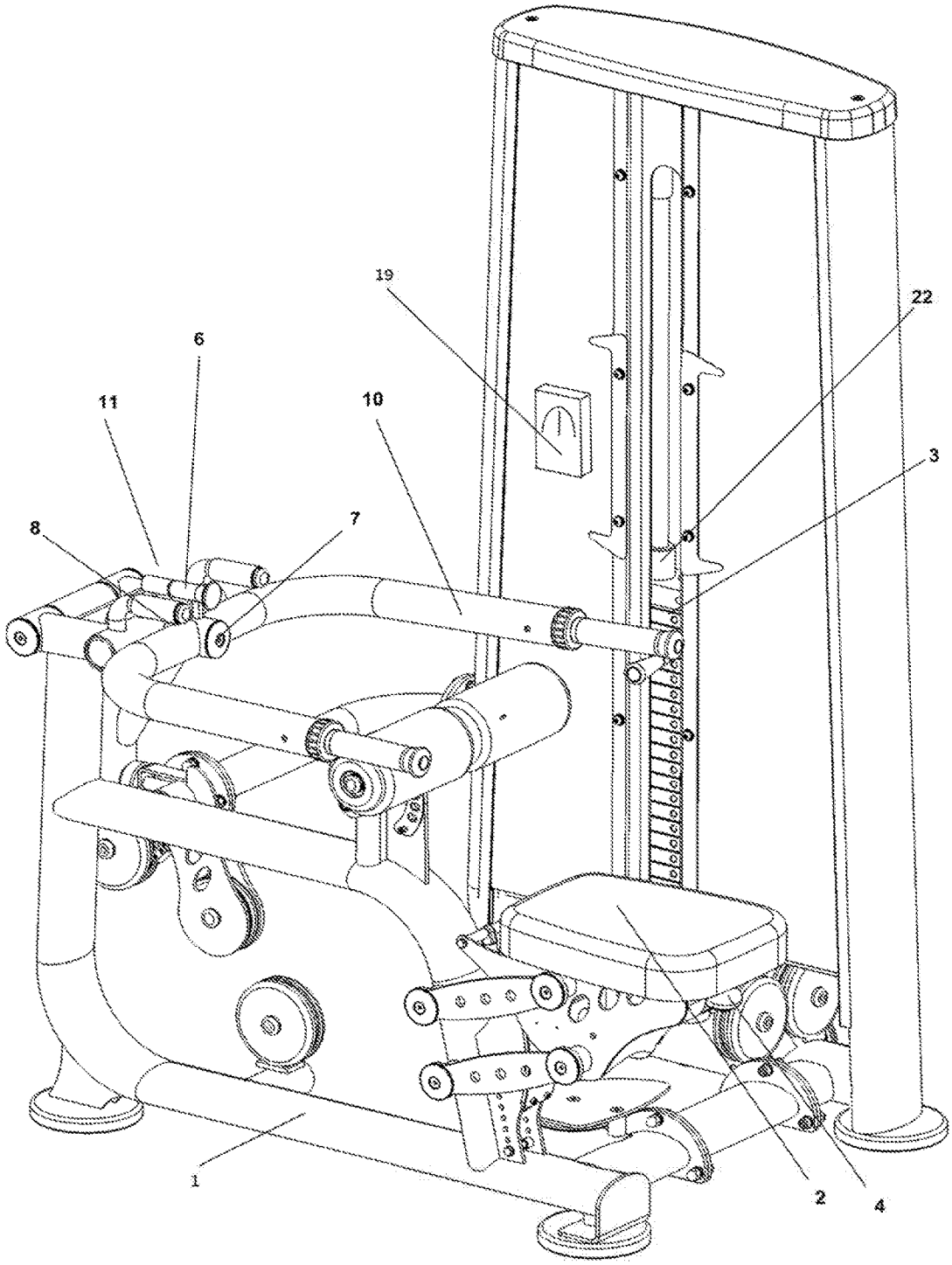
FIG. 5 shows one of the preferred embodiment and the main components of the stationary strength training equipment with a lockable bilateral user interface.
Figure 6:
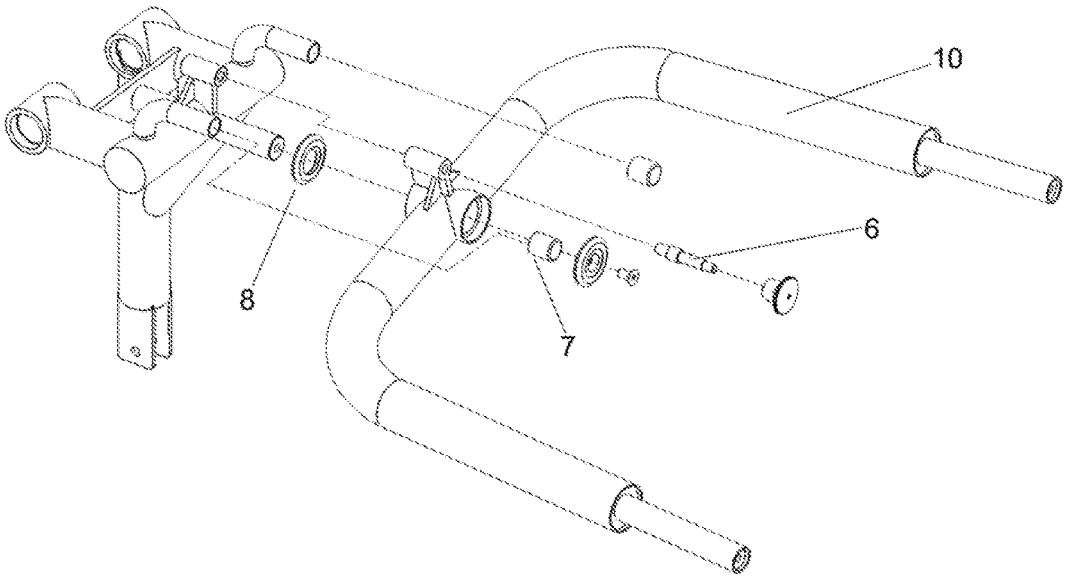
FIG. 6 shows the main components of the locking and pivoting mechanism of the stationary strength training equipment with a lockable bilateral user interface as shown in FIG. 5.

Referring to FIGS. 5-6, one of the preferred embodiments of the stationary strength training equipment according to the present invention is a seated DIP machine, which includes the lockable bilateral user interface (11) for enhanced bilateral strength training of the upper body.

As embodied in FIG. 5, the frame assembly (1) is the structural frame of the DIP machine. The user sits on the seat (2) which is adjustable in position for ability and comfort by the seat adjustment (4). The user selectable weight (3) is controlled by cables, via pulleys, connected to the lockable bilateral user interface (11) consisting of a balancing structure (10), a locking mechanism assembly (6) and a central pivot assembly (7) a load detecting strain gauge (22), a position sensor module (8) and the informing device (19).

Different from the previous embodiment, the balancing structure (10) is preferably a handgrip. The operation mechanism of the seated DIP machine is similar to the previous embodiment and thus not repeated hereinafter.

Referring to FIGS. 7-10, the preferred embodiments of the informing device for use with the stationary strength training equipment according to the present invention which includes the lockable bilateral user interface (11) for enhanced bilateral strength training of the lower or upper body.

Figure 7:
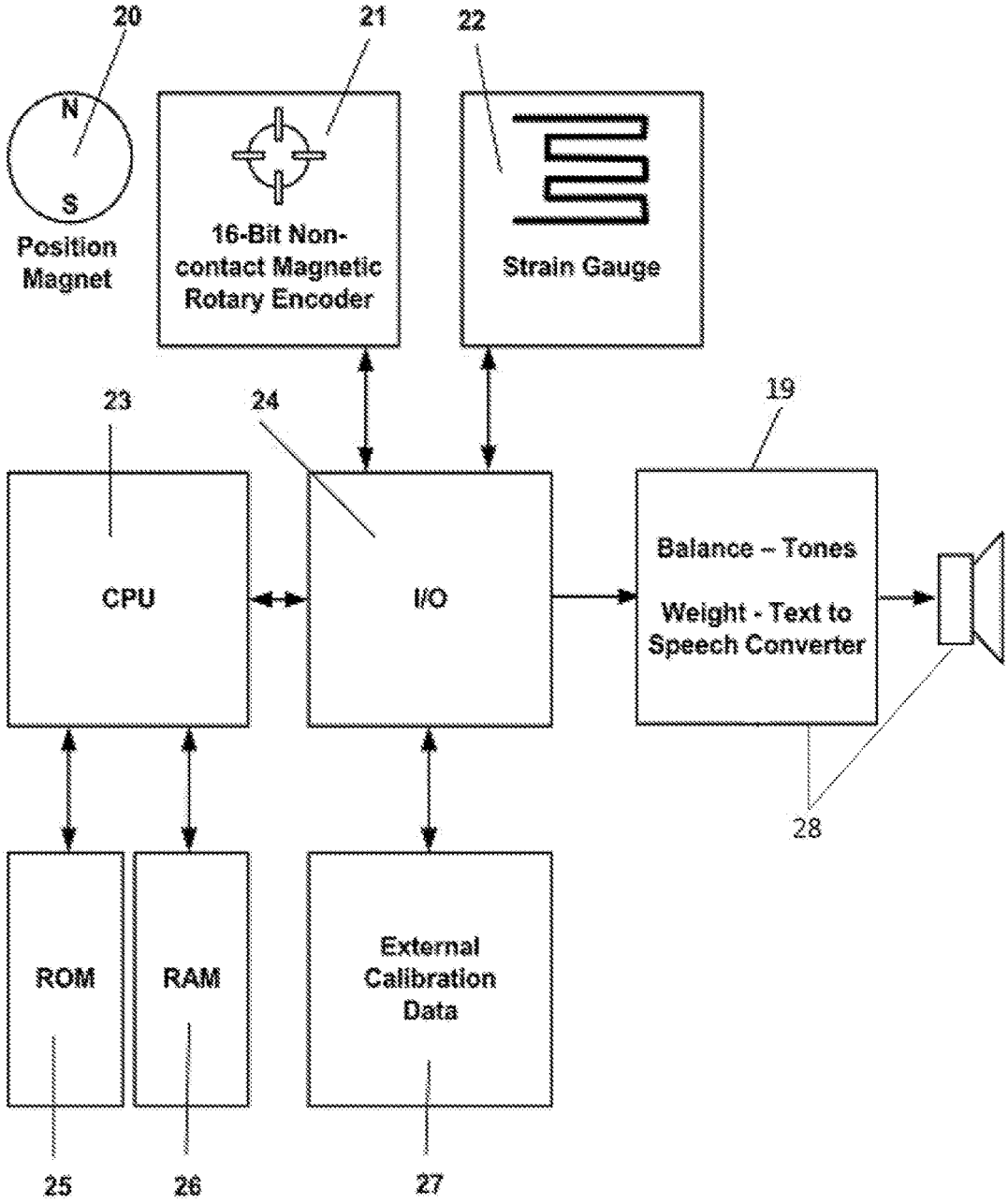
FIG. 7 shows the main components of the audible version of the informing device of the stationary strength training equipment with a lockable bilateral user interface.

As embodied in FIG. 7, the position magnet (20) rotates in sympathy with the unlocked user interface, causing a signal, which is in proportion to the degrees of difference of either side of the user interface, to be produced in the 16-bit non-contact magnetic rotary encoder (21) which is directed to the CPU (23) for processing. A load detecting strain gauge (22) produces a signal, which is in proportion to the weight being lifted is also directed to the CPU (23) for processing. Software and processing algorithms reside in ROM (25). Machine specific calibration data is installed via the external calibration data port (27). The processed data is sent to the informing device (19), which is in this instance including an audible tone and voice system (28).

Figure 8:
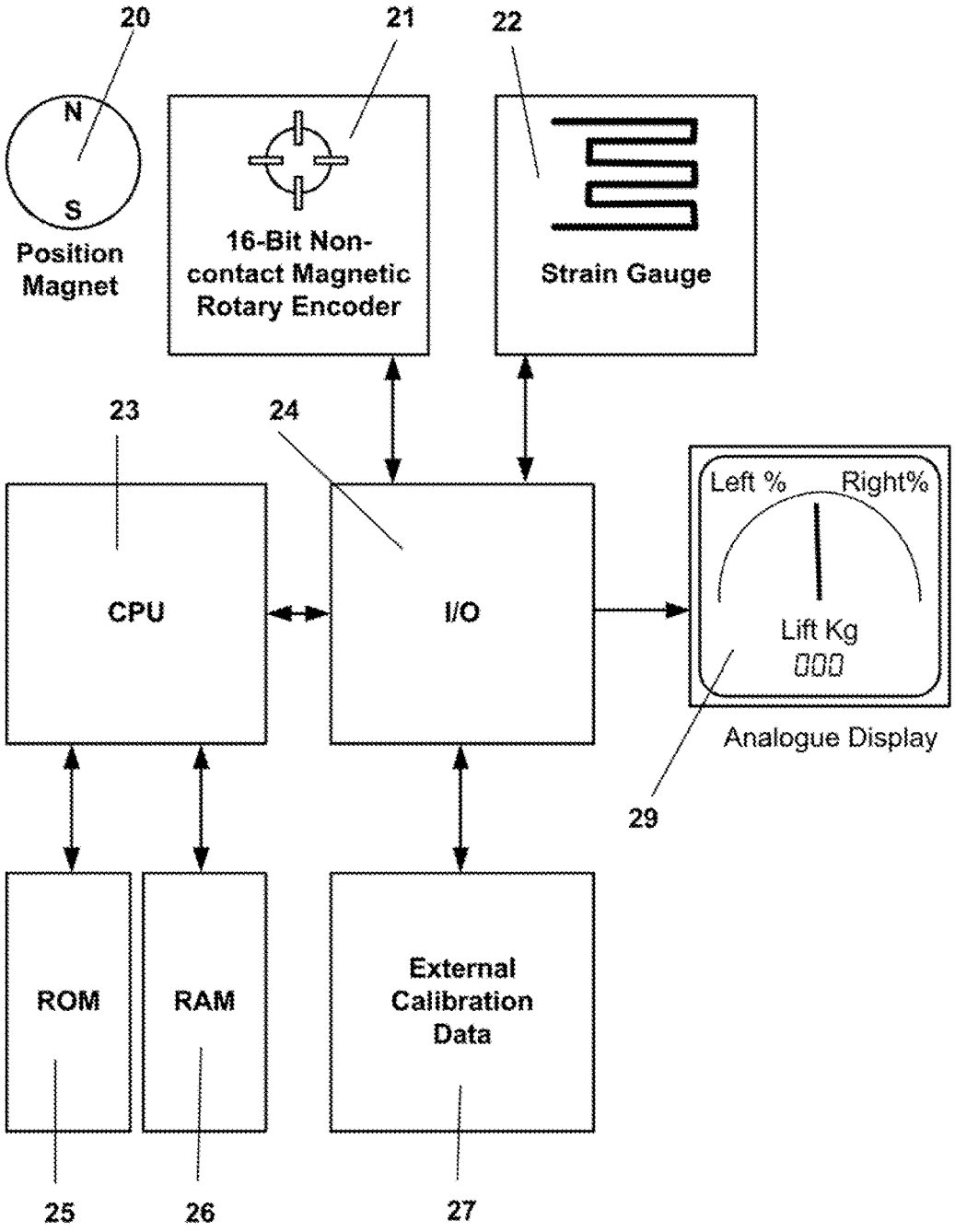
FIG. 8 shows the main components of the analogue display version of the informing device of the stationary strength training equipment with a lockable bilateral user interface.

Referring to FIG. 8, different from the previous embodiment, the informing device (19) is preferably an analogue display (29). The operation mechanism the informing device (19) is similar to the previous embodiment and thus not repeated hereinafter.

Figure 9:
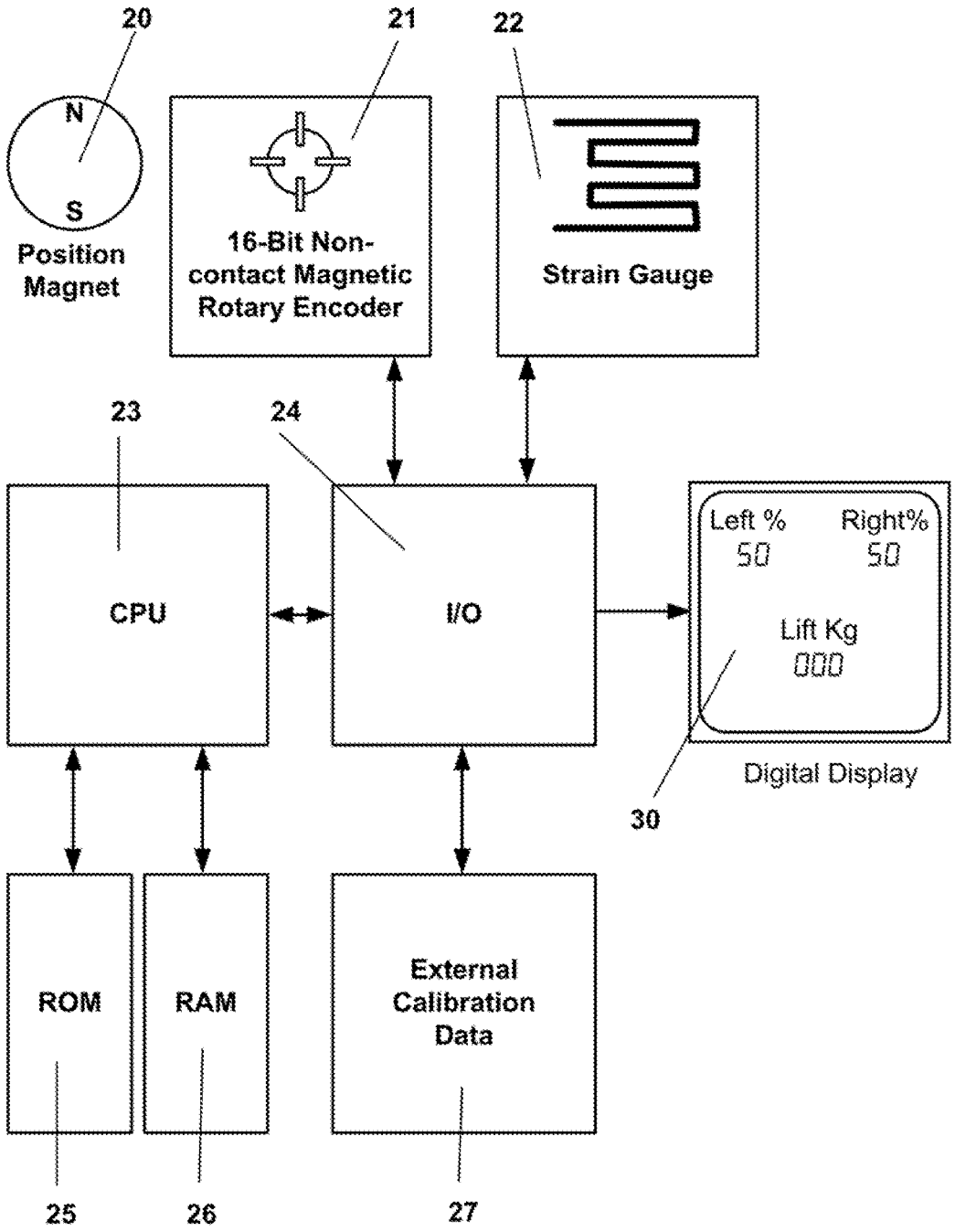
FIG. 9 shows the main components of the digital display version of the informing device of the stationary strength training equipment with a lockable bilateral user interface.

Referring to FIG. 9, different from the previous embodiment, the informing device (19) is preferably a digital display (30). The operation mechanism the informing device (19) is similar to the previous embodiment and thus not repeated hereinafter.

Figure 10:
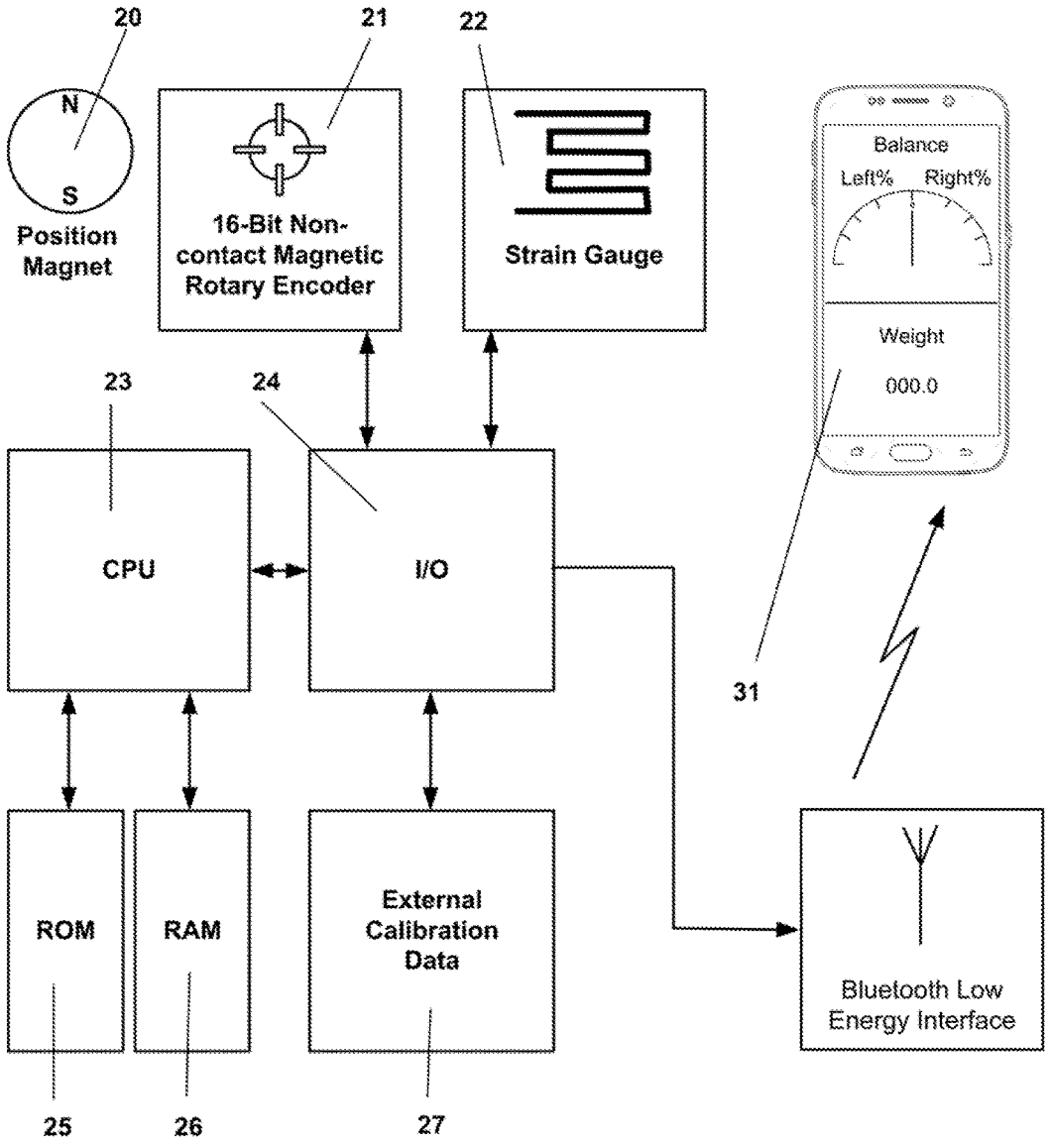
FIG. 10 shows the main components of the wireless version of the informing device of the stationary strength training equipment with a lockable bilateral user interface.

Referring to FIG. 10, different from the previous embodiment, the informing device (19) is preferably a wireless coupled smart phone or tablet PC (31). The operation mechanism the informing device (19) is similar to the previous embodiment and thus not repeated hereinafter.

Although the present invention has been described with reference to the foregoing preferred embodiments, it will be understood that the invention is not limited to the details thereof. Various equivalent variations and modifications can still occur to those skilled in this art in view of the teachings of the present invention. Thus, all such variations and equivalent modifications are also embraced within the scope of the invention as defined in the appended claims.

What is claimed is:

1. A stationary strength training equipment, comprising:

a frame assembly;

a lockable bilateral user interface installed on the frame assembly;

a balancing structure connected to the lockable bilateral user interface;

a plurality of user selectable weights supported by the frame assembly and connected to the balancing structure;

a load detecting strain gauge disposed on the user selectable weights and configured to detect a weight of the user selectable weights being lifted; and a position sensor module is connected to the lockable bilateral user interface and configured to detect a balancing status and show a warning signal to a user via an informing device, wherein the lockable bilateral user interface further includes a locking mechanism assembly and a central pivot assembly; the balancing structure is able to rotate about the central pivot assembly, and the locking mechanism assembly selectively restricts a rotation of the balancing structure.

2. The stationary strength training equipment according to claim 1, wherein when the locking mechanism assembly is unlocked, the balancing structure is able to rotate when uneven force is applied to opposite sides of the balancing structure, and the informing device is able to show an unbalance warning signal to a user.

3. The stationary strength training equipment according to claim 2, wherein the balancing structure is a rod.

4. The stationary strength training equipment according to claim 2, wherein the balancing structure is a press plate.

5. The stationary strength training equipment according to claim 2, wherein the balancing structure is a handgrip.

* * * * *